US006392472B1

(12) United States Patent
Kobayashi et al.

(10) Patent No.: US 6,392,472 B1
(45) Date of Patent: May 21, 2002

(54) CONSTANT INTERNAL VOLTAGE GENERATION CIRCUIT

(75) Inventors: Mako Kobayashi; Fukashi Morishita, both of Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/954,218

(22) Filed: Sep. 18, 2001

Related U.S. Application Data

(63) Continuation-in-part of application No. 09/466,670, filed on Dec. 20, 1999, now abandoned.

(30) Foreign Application Priority Data

Jun. 18, 1999 (JP) ..... 11-173044

(51) Int. Cl.[7] ..... G05F 1/575

(52) U.S. Cl. ..... 327/541; 327/543; 365/189.09; 323/314

(58) Field of Search ..... 327/538, 540, 327/541, 543, 545, 546; 365/189.09; 323/314

(56) References Cited

U.S. PATENT DOCUMENTS 5,189,316 A * 2/1993 Murakami et al. ..... 327/530
5,249,155 A * 9/1993 Arimoto et al. ..... 327/542
5,353,935 A * 10/1994 Yamamura et al. ..... 327/540
5,367,491 A * 11/1994 Han et al. ..... 327/72
5,594,695 A * 1/1997 Yim et al. ..... 327/72
5,689,461 A * 11/1997 Kaneko et al. ..... 365/189.07
5,694,364 A * 12/1997 Morishita et al. ..... 365/201
5,783,956 A * 7/1998 Ooishi ..... 327/157
5,886,565 A * 3/1999 Yasui et al. ..... 327/540
6,025,707 A * 2/2000 Joo ..... 327/77
6,034,567 A * 3/2000 Umezama et al. ..... 330/253
6,046,624 A * 4/2000 Nam et al. ..... 327/538

FOREIGN PATENT DOCUMENTS

JP 4-162289 * 6/1992 ..... G11C/11/407

OTHER PUBLICATIONS

Kiyoo ITO, "Ultra LSI Memory", Nov. 5, 19094,BAIFU-KAN, pp. 267–273.*

* cited by examiner

*Primary Examiner*—Terry D. Cunningham
*Assistant Examiner*—Terry L. Englund
(74) *Attorney, Agent, or Firm*—McDermott, Will & Emery

(57) ABSTRACT

A voltage generation circuit includes a digital type VDC. The digital VDC includes a differential amplify circuit amplifying a voltage deviation of a reference voltage signal from a detection voltage signal to output the amplified voltage to a control node, a signal conversion circuit providing either an H level or an L level according to the voltage level of the control node, and an output transistor connecting an external power supply line and an internal power supply voltage node according to an output voltage of the signal conversion circuit. The center of the range of the varying voltage level of the control node is set by shifting to the logic threshold value of the signal conversion circuit.

21 Claims, 12 Drawing Sheets

CONSTANT INTERNAL VOLTAGE GENERATION CIRCUIT

RELATED APPLICATIONS

This application is a Continuation-In-Part of U.S. patent application Ser. No. 09/466,670, filed Dec. 20, 1999, incorporated herein by reference and now abandoned.

BACKGROUND OF THE INVENTION

1. Field of the Invention

The present invention relates to voltage generation circuits. More particularly, the present invention relates to a voltage generation circuit that can supply power supply voltage speedily and stably with respect to the load of abrupt current consumption under low voltage operation, and the structure of a semiconductor memory device incorporating such a voltage generation circuit.

2. Description of the Background Art

Efforts have been exerted to reduce the operating voltage of LSI memories in accordance with the growing demand for operation at lower power consumption in the market. There is a great demand for the transistors in the chip to operate under a driving current lower than the external power supply voltage that is applied to the chip. This is also necessary from the standpoint of ensuring reliability of the transistor itself that is reduced in size due to the increase of the integration density.

Particularly, in a type of a memory such as a DRAM (Dynamic Random Access Memory), lowering the operating voltage is an important factor from the aspect of ensuring reliability of the dielectric film of the capacitor that becomes the capacitance accumulation portion in a memory cell.

To meet the above requirements, the upper limit of the internal power supply voltage has become lower with respect to the external power supply voltage used in the system as the development generation proceeds. To this end, a voltage down converter (VDC) is employed as the circuit to generate stable internal power supply voltage to ensure such reliability in the chip.

FIG. 22 is a circuit diagram showing a structure of a conventional analog type VDC 700 correspond to one basic structure of a VDC.

Analog VDC 700 receives a reference voltage Vref which is the target voltage of the internal power supply voltage used in the chip from a Vref generation circuit (not shown) to maintain stably a voltage int.Vcc at an internal power supply voltage node 715.

Referring to FIG. 22, analog VDC 700 includes a differential amplify circuit 730 and a current control transistor 740 connected in series between an external power supply line 711 and a ground line 712. Differential amplify circuit 730 generates at a control node Ncp a voltage which is an amplified version of the voltage difference between the voltage at internal power supply voltage node 715 and standard voltage Vref. Differential amplify circuit 730 is a current mirror amplify circuit with P type MOS transistors QPa and QPb as the load.

Current control transistor 740 connected between differential amplify circuit 730 and ground line 712 receives an activation signal ACT at its gate. ACT signal is used to control the operation of analog VDC 700. When activation signal ACT is rendered active (H level), current is supplied to differential amplify circuit 730. A desired operation is carried out by means of analog VDC 700 carrying out error amplification of the voltage difference between reference voltage Vref and voltage int.Vcc.

Analog VDC 700 further includes an output transistor 760 having its gate connected to control node Ncp, and connecting an external power supply line 711 with internal power supply voltage node 715.

When int.Vcc≈Vref, the voltage at control node Ncp which is the output of differential amplify circuit 730 attains a high level. Therefore, output transistor 760 is turned off, so that current is not supplied to internal power supply voltage node 715.

When int.Vcc<Vref, the voltage of control node Ncp is amplified towards the lower level by differential amplify circuit 730. Output transistor 760 is turned on, so that current is supplied to internal power supply voltage node 715 through external power supply line 711. Thus, voltage int.Vcc at internal power supply voltage node 715 can be controlled to the level of Vref which is the target voltage.

FIG. 23 is a circuit diagram showing a structure of a conventional digital type VDC 800 which is another example of a VDC.

Digital VDC 800 sets the gate voltage of the output transistor to either the H level or the L level in a digital manner, whereby the output transistor is driven.

Referring to FIG. 23, digital VDC 800 differs from analog VDC 700 of FIG. 22 in that a signal conversion circuit 750 is further provided between control node Ncp and the gate of output transistor 760. Signal conversion circuit 750 includes inverters I1 and I2 connected in series. Inverter I1 has its input node connected to control node Ncp. Inverter I2 has its output node connected to the gate of output transistor 760.

By the above structure, a voltage of either the H or L level is applied to the gate of output transistor 760 according to the relationship between the voltage of control node Ncp and the logic threshold voltage of the inverter. Since digital VDC 800 amplifies the output of differential amplify circuit 730 to the CMOS level to switch the output transistor, a large current can be supplied speedily by output transistor 760 even if the driving current of differential amplify circuit 730 is low.

In an analog VDC 700, although the gate voltage of output transistor 760 can be altered according to the reduction level of voltage int.Vcc to supply a current corresponding to the level of the consumed current, an output transistor 760 of a large size must be driven by the output of differential amplify circuit 730 that cannot easily take a large driving current. There was a problem that the operation in the VDC is greatly delayed.

In a digital VDC 800, in contrast, a large amount of current can be supplied speedily even when the output signal of differential amplify circuit 730 is low since the output transistor is switched with the output of differential amplify circuit 730 amplified to the CMOS level.

However, it is to be noted that the voltage of control node Ncp which is the output of differential amplify circuit 730 varies in the range of Vn0 to ext.Vcc where Vn0 is the voltage of node Nn0 in FIG. 23 for digital VDC 800. Since voltage Vn0 corresponds to a level boosted by the channel resistance of current control transistor 740 from the ground voltage, the voltage generated at control node Ncp will change only within a narrow range if ext.Vcc is lowered. As a result, the output transistor cannot be turned on easily. Therefore, there is a possibility that power cannot be applied to the internal power supply voltage node speedily under the low voltage operation.

Although the conventional digital type VDC has speedy response due to its great amplification of the system, the problem of oscillation in the VDC per se and generation of overshooting and undershooting is encountered. There is a tendency that the control to supply the internal power supply voltage stably cannot be provided easily.

SUMMARY OF THE INVENTION

An object of the present invention is to provide a structure of a voltage generation circuit that can supply an internal power supply voltage stably and speedily even under lowered external power supply voltage.

According to an aspect of the present invention, a voltage generation circuit receiving an external power supply voltage and maintaining an internal power supply voltage at a target voltage to supply that voltage to a load includes an external power supply line, an internal power supply voltage node, and a voltage conversion circuit.

The external power supply voltage is supplied through the external power supply line. The internal power supply voltage is output from the internal power supply voltage node. The voltage conversion circuit controls the current flow supplied from the external power supply line to the internal power supply voltage node according to a voltage deviation of the internal power supply voltage from the target voltage to maintain the internal power supply voltage at the target voltage.

The voltage conversion circuit includes a switch circuit coupled between a first voltage and an internal node, and turned on according to an activation signal of the voltage generation circuit, an amplily circuit coupled between the internal node and a second voltage to generate a detection deviation signal having a voltage level according to the voltage deviation in the range from the voltage level of the internal node to the second voltage, and a signal conversion circuit driving the voltage level of an output control signal to either the first or second voltage according to the voltage level of the detection deviation signal, and an output current control circuit controlling the output current amount according to the voltage level of the output control signal. The output current control circuit increases the current flow as the voltage level of the detection deviation signal varies from the first voltage to the second voltage.

According to another aspect of the present invention, a semiconductor memory device receiving supply of an external power supply voltage for operation includes a memory cell array, a sense amplifier circuit, a plurality of peripheral circuits, and a voltage generation circuit.

The memory cell array includes a plurality of memory cells arranged in a matrix. The sense amplifier circuit amplifies the output data from a selected memory cell. The plurality of peripheral circuits control the data input/output operation with respect to the memory cell array. Each circuit in the semiconductor memory device is divided into a plurality of circuit groups according to the current consumption pattern. The voltage generation circuit receives an external power supply voltage, and maintains the operating voltage at the target voltage to supply that voltage to one of the plurality of circuit groups that includes the sense amplifier circuit.

The voltage generation circuit includes an external power supply line from which an external power supply voltage is supplied, an operating voltage supply node generating an operating voltage, and a voltage conversion circuit controlling the current flow supplied from the external power supply line to the operating voltage supply node to maintain the operating voltage at the target voltage according to a voltage deviation of the operating voltage from the target voltage. The voltage conversion circuit includes a switch circuit coupled between a first voltage and an internal node, and turned on according to an activation signal of the voltage generation circuit, an amplify circuit coupled between the internal node and a second voltage, generating a detection deviation signal having its voltage level according to a voltage deviation of the operating voltage from the target voltage in the range from the voltage level of the internal node to the second voltage, a signal conversion circuit driving the voltage level of the output control signal to either the first or second voltage according to the voltage level of the detection deviation signal, and an output current control circuit controlling the output current flow according to the voltage level of the output control signal. The output current control circuit increases the current flow as the voltage level of the detection deviation signal varies from the first voltage to the second voltage.

Therefore, the main advantage of the present invention is that the control response of the internal power supply voltage even under lowered external power supply voltage can be improved since the center of the range of the varying detection deviation voltage is shifted to the voltage level side designating ON of the output current control circuit and since the ON/OFF of the output current control circuit is controlled according to the detection deviation voltage.

By incorporating such a voltage generation circuit, a semiconductor memory device can be provided that can supply an operating power supply voltage stably to a sense amplifier circuit having an abrupt consumed current waveform.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
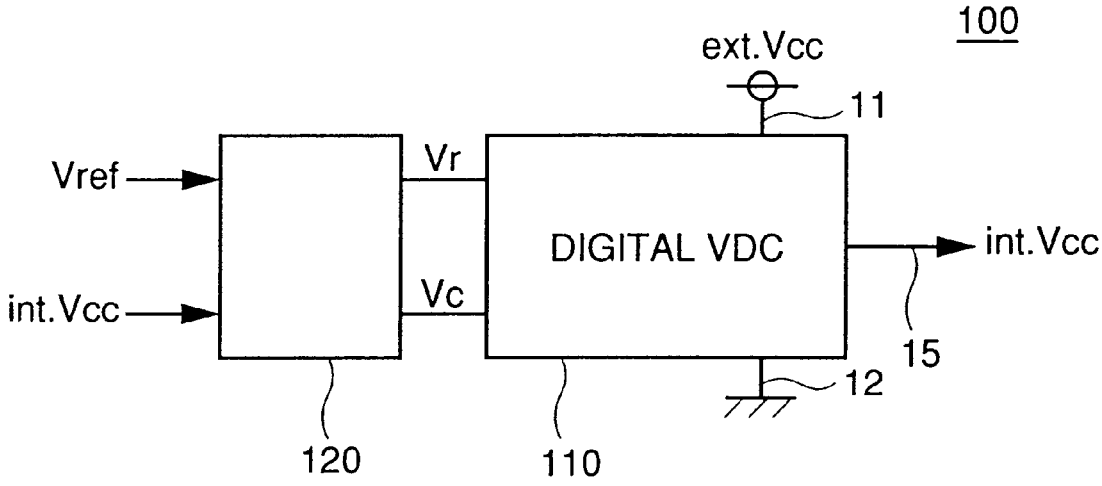
FIG. 1 is a schematic block diagram showing an entire structure of a voltage generation circuit 100 according to a first embodiment of the present invention.

Embodiments of the present invention will be described hereinafter with reference to the drawings. In the drawings, the same reference characters designate the same or corresponding components.

First Embodiment

FIG. 1 is a schematic block diagram showing an entire structure of a voltage generation circuit 100 according to a first embodiment of the present invention.

Referring to FIG. 1, voltage generation circuit 100 includes a voltage shift circuit 120 receiving an internal power supply voltage int.Vcc and a target voltage Vref of ext.Vcc, and generating a reference voltage signal Vr and a detection voltage signal Vc obtained by converting the level of the voltages, and a digital VDC 110 controlling voltage int.Vcc at a constant level by supplying a current from an external power supply line 11 to an internal power supply voltage node 15 (referred simply as "supply node" hereinafter) according to the difference between reference voltage signal Vr and detection voltage signal Vc.

Voltage shift circuit 120 includes a reference voltage signal generation circuit 121 generating reference voltage signal Vr, and a detection voltage signal generation circuit 122 generating detection voltage signal Vc. Reference voltage signal Vr has its voltage level set lower than the level of target voltage Vref. Similarly, detection voltage signal Vc is set according to voltage int.Vcc, and has a voltage level lower than that of int.Vcc.

Figure 2:
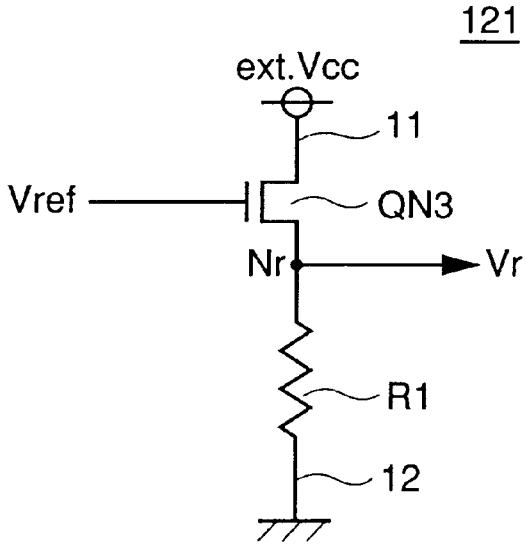
FIG. 2 is a circuit diagram showing a structure of a reference voltage signal generation circuit 121.

Referring to FIG. 2, reference voltage signal generation circuit 121 includes an N type MOS transistor QN3 receiving target voltage Vref at its gate to connect external power supply line 11 with a node Nr from which reference voltage signal Vr is generated, and a resistance element R1 connected between node Nr and a ground line 12.

By the above structure, a voltage corresponding to and lower than voltage Vref is generated at node Nr. The voltage level of node Nr is transmitted to VDC 110 as reference voltage signal Vr.

Figure 3:
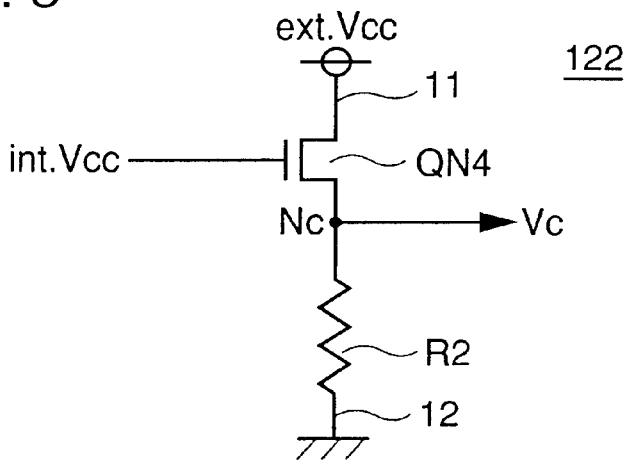
FIG. 3 is a circuit diagram showing a structure of a detection voltage signal generation circuit 122.

Referring to FIG. 3, detection voltage signal generation circuit 122 having a structure similar to that of reference voltage signal generation gate circuit 121 includes an N type MOS transistor QN4 connected between a node Nc from which detection voltage signal Vc is generated and external power supply line 11, receiving int.Vcc at its gate, and a resistance element R2 provided between node Nc and ground line 12.

According to the above structure, detection voltage signal Vc generated at node Nc has a voltage level corresponding to and lower than int.Vcc.

Reference voltage signal Vr and detection voltage signal Vc are transmitted to digital VDC 110. Digital VDC 110 responds to detection of both voltages to control the voltage of int.Vcc.

Figure 4A:
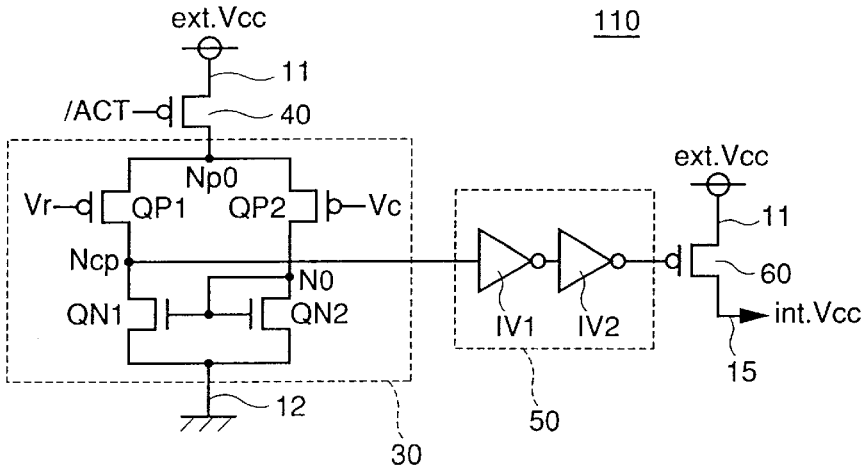
FIGS. 4A and 4B are circuit diagrams showing a first exemplified structure and a second exemplified structure, respectively, of a digital VDC according to the first embodiment of the present invention.

Referring to FIG. 4A, digital VDC 110 includes an differential amplify circuit 30 amplifying the voltage difference between reference voltage signal Vr and detection voltage signal Vc and providing the amplified difference to a control node Ncp, and a current control transistor 40 connected between external power supply line 11 and differential amplify circuit 30 to limit the current supplied to differential amplify circuit 30.

Differential amplify circuit 30 has a structure of the general current mirror circuit. The structure of differential amplify circuit 30 has the P type MOS transistor and the N type MOS transistor exchanged as compared to differential amplify circuit 730 of the conventional digital VDC 800. Differential amplify circuit 30 amplifies the voltage difference between reference voltage signal Vr applied to the gate of transistor QP1 and detection voltage signal Vc applied to the gate of transistor QP2 to provide the amplified difference to control node Ncp.

Current control transistor 40 receives an activation signal/ACT at its gate. For example, when the chip is rendered active and signal/ACT attains an active level (L level), current control transistor 40 is turned on, whereby current is supplied to differential amplify circuit 30.

Differential amplify circuit 30 includes a P type MOS transistor QP1 and an N type MOS transistor QN1 connected in series between a node Np0 and ground line 12, and a P type MOS transistor QP2 and an N type MOS transistor QN2 connected in parallel with transistors QP1 and QN1.

Transistor QP1 connected between node Np0 and control node Ncp receives reference voltage signal Vr at its gate. Transistor QP2 connected between nodes Np0 and N0 receives detection voltage signal Vc at its gate.

Transistor QN1 connected between control node Ncp and ground line 12 has its gate connected to node N0. Similarly, transistor QN2 connected between nodes N0 and ground line 12 has its gate connected to node N0.

By applying to the gates of transistors QP1 and QP2, not voltages Vref and int.Vcc, but signals Vr and Vc obtained by conversion into a lower voltage level, the gate-source voltage of transistors QP1 and QP2 can be ensured even when the operating voltage is lowered so that the voltage of ext.Vcc is set to a lower level. Therefore, the voltage difference therebetween can be amplified and generated at control node Ncp.

Digital VDC 110 further includes a signal conversion circuit 50 connected between control node Ncp and the gate of output transistor 60.

Signal conversion circuit 50 includes inverters IV1 and IV2 connected in series. Inverter IV2 generates an output control signal to set the gate voltage of an output transistor 60 to either the H or L level digitally.

Digital VDC 110 further includes an output transistor 60 receiving the output control signal at its gate, and connecting external power supply line 11 with supply node 15.

Output transistor 60 is turned on/off according to the voltage level of the output control signal from signal conversion circuit 50 to supply current, when necessary, from external power supply line 11 to supply node 15.

In digital VDC 110, the voltage level of reference voltage signal Vr is compared with that of detection voltage signal Vc by differential amplify circuit 30, whereby the voltage level of control node Ncp falls when the level of Vc is lower. When voltage Vcp at control node Ncp becomes lower than the logic threshold voltage of inverter IV1, inverter IV1 provides an output of an H level (ext.Vcc), and the output control signal from inverter IV2 is set at the L level (ground voltage GND). In response, output transistor 60 is turned on, whereby current is supplied to supply node 15.

The voltage generation circuit of the present invention is directed to restrict the supply current of differential amplify circuit 30 and improve the response speed of voltage control by arranging current control transistor 40 at the side of external power supply line 11 and by setting the lower limit of the voltage variation at control node Ncp to the ground voltage level in digital VDC 110.

Figure 4B:
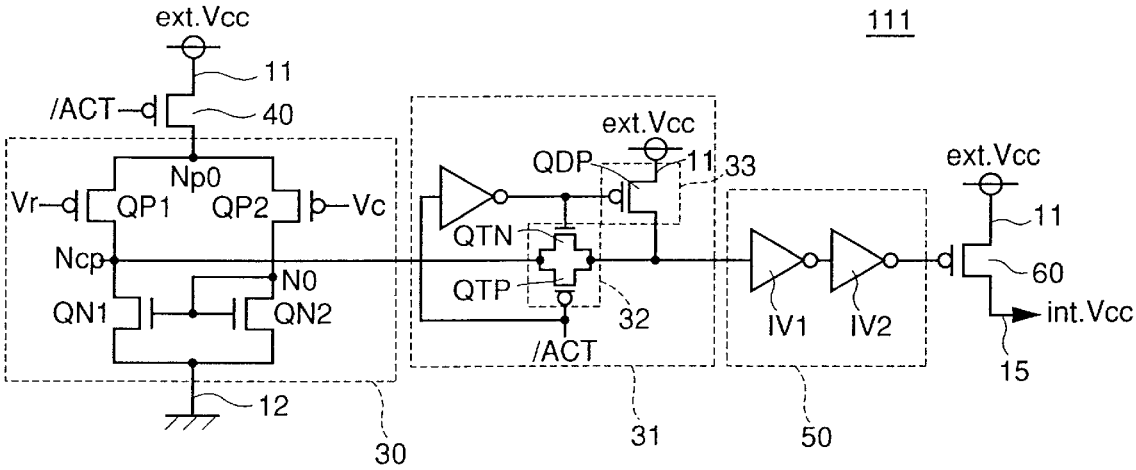

Referring to FIG. 4B, a digital VDC 111 according to another structure of the first embodiment differs from digital VDC 110 shown in FIG. 4A in further including a voltage fixing circuit 31.

Voltage fixing circuit 31 includes a voltage transmission unit 32 connected between control node Ncp and signal conversion circuit 50, and a voltage fixing switch 33. Voltage transmission unit 32 includes an N type MOS transistor QTN and a P type MOS transistor QTP connected between control node Ncp and the NCP input side of inverter IV1 in signal conversion circuit 50. An inverted signal of activation signal/ACT is input to the gate of N type MOS transistor QTN. Activation signal/ACT is input to the gate of P type MOS transistor QTP.

Voltage fixing switch 33 includes a P type MOS transistor QDP provided between the input side of inverter IV1 and external power supply line 11, receiving an inverted signal of activation signal/ACT at its gate.

Since activation signal/ACT is rendered active (L level) when digital VDC 111 operates, N type MOS transistor QTN and P type MOS transistor QTP are turned on, whereas P type MOS transistor QDP is turned off.

Therefore, voltage transmission unit 32 connects control node Ncp with the input side of inverter IV1 in signal conversion circuit 50. Voltage fixing switch 33 electrically disconnects the input side of the inverter IV1 from external power supply line 11. As a result, the operation of digital type VDC 111 is similar to digital VDC110 of FIG. 4A.

In contrast, when the operation of digital VDC 111 is not required, activation signal/ACT is rendered inactive (H level). In this case, current control transistor 40 is turned off so that supply of operating current to differential amplify circuit 30 is suppressed. Therefore, control node Ncp attains a floating state. Voltage fixing circuit 31 is provided to prevent output transistor 60 from being turned on/off in response to the voltage of control node Ncp at a floating state in such a case.

When activation signal/ACT is rendered inactive (H level), voltage fixing circuit 31 has N type MOS transistor QTN and P type MOS transistor QTP turned off, and P type MOS transistor QDP turned on. Accordingly, voltage transmission unit 32 disconnects control node Ncp from the input side of the inverter IV1 in signal conversion circuit 50. Voltage fixing switch 33 electrically couples the input side of inverter IV1 with external power supply line 11 since the output control signal is set so as to turn off output transistor 60.

As a result, the input of signal conversion circuit 50 is disconnected from control node Ncp attaining a floating state, and is fixed to ext.Vcc.

Thus, output transistor 60 can be reliably turned off when the operation of digital VDC 111 is not required.

The operation of digital VDC 110, 111 with respect to transition in int.Vcc will be described with reference to the waveform diagram of FIG. 5.

Here, the case where the level of voltage int.Vcc falls linearly at a constant inclination is considered. The voltage level of detection voltage signal Vc also falls linearly as the level of voltage int.Vcc is reduced.

Detection voltage signal Vc becomes lower than reference voltage signal Vr at time ta, resulting in int.Vcc<Vref.

Figure 5:
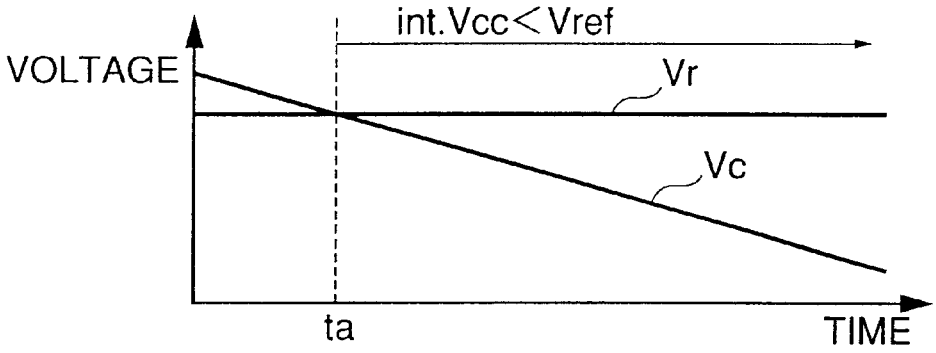
FIG. 5 is a waveform diagram to describe transition in the voltage level of int.Vcc.
Figure 6:
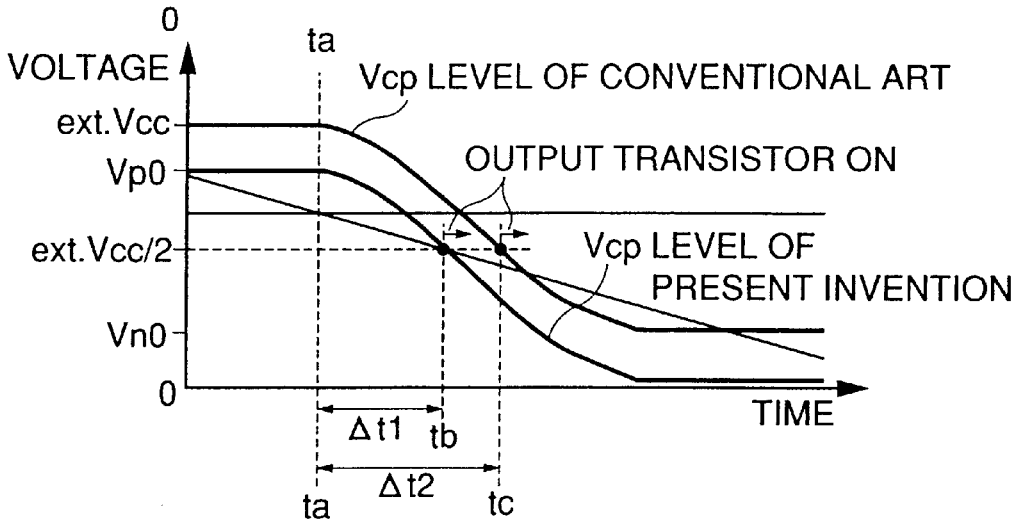
FIG. 6 is a waveform diagram to describe an operation of digital VDC 110 with respect to transition in voltage int.Vcc.

FIG. 6 is a waveform diagram to describe the operation of digital VDC 110, 111 as voltage int.Vcc shown in FIG. 5 changes. In FIG. 6, change in voltage level Vcp of control node Ncp with respect to the transition in int.Vcc is shown in comparison between the conventional digital VDC and the inventive digital VDC 110.

Voltage Vp0 corresponds to the voltage level of node Np0 at the state where/ACT=L level is applied to current control transistor 40. Vp0 corresponds to a voltage level reduced by the channel resistance of current control transistor 40 from ext.Vcc.

Figure 23:
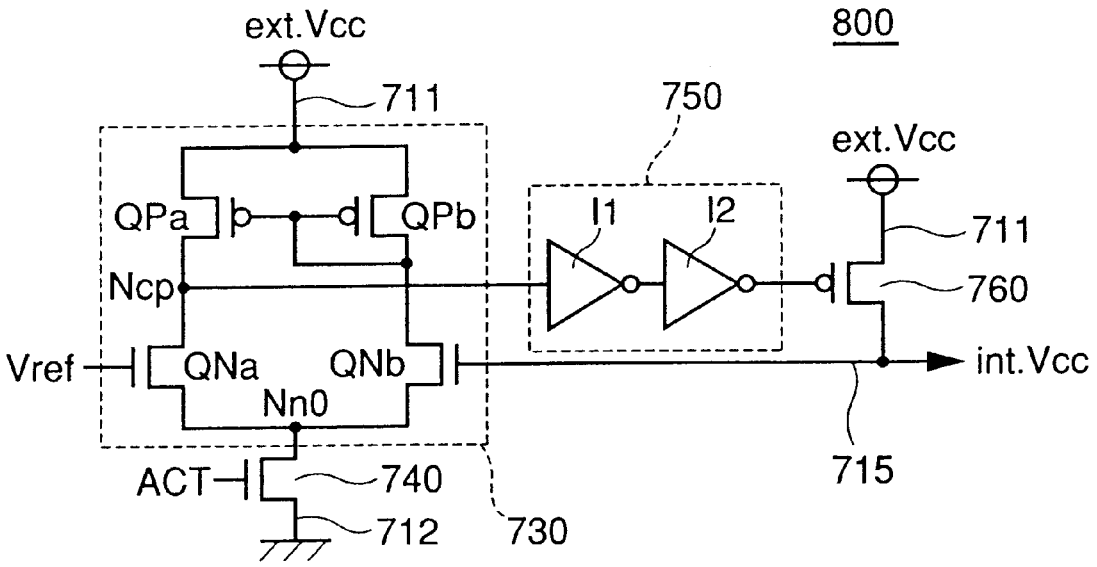
FIG. 23 PRIOR ART
FIG. 23 is a circuit diagram showing a structure of a conventional digital VDC 800.

Voltage Vn0 corresponds to the voltage level of node Nn0 when current control transistor 740 of FIG. 23 is on, and is higher by the channel resistance of current control transistor 740 than ground voltage GND.

When Vc becomes lower than the voltage level of Vr at time ta, Vcp begins to gradually fall.

At time tb corresponding to an elapse of Δt1 from time ta, the voltage level of Vcp becomes lower than ext.Vcc/2 which is the logic threshold voltage of inverter IV1 in digital VDC 110, 111. Therefore, the outputs of inverters IV1 and IV2 are inverted. Accordingly, output transistor 60 is turned on.

In contrast, the voltage level of Vcp becomes lower than ext.Vcc/2 which is the logic threshold voltage of inverter IV1 at time tc corresponding to an elapse of Δt2 from time ta in the conventional digital VDC 800.

Therefore, in the case where control is to be provided according to the same detection voltage signal, the time required for output transistor 60 to be turned on is Δt2 corresponding to Vcp becoming as low as ext.Vcc/2 from ext.Vcc for the conventional digital VDC 800, and is Δt1 corresponding to the voltage level of the control node falling to ext.Vcc/2 from Vp0 for digital VDC 110, 111. Therefore, Δt1 is shorter than Δt2.

Attention is focused on this difference in response as to the case of supplying an operating power supply voltage with the sense amplifier circuit to amplify the data in the memory cell of the memory device as the load, for example.

Figure 7:
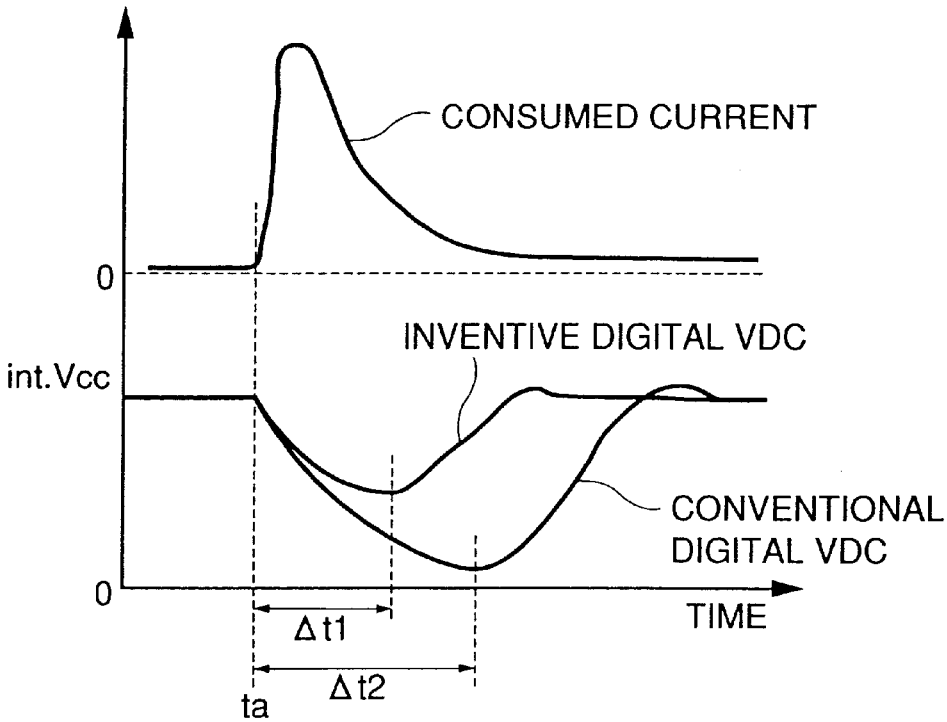
FIG. 7 is a waveform diagram to describe the relationship between the consumed current of a sense amplifier circuit which is the load and transition of voltage int.Vcc.

FIG. 7 is a diagram of the concept representing the relationship between the consumed current of the sense amplifier circuit and transition of power supply voltage int.Vcc in a normal sense amplifier operation.

At time ta, the sense amplifier circuit is activated, whereby a spike current of which is on the order of several hundred mA is consumed during approximately several ten ns by the charge of the data line, as compared to the previous current consumption of 0. Accordingly, the voltage level of int.Vcc falls abruptly from time ta.

Since conventional digital VDC 800 requires the time of Δt2 before the output transistor is turned on as described with reference to FIG. 6, the drop of the voltage level of int.Vcc becomes great. Therefore, a long period of time is required before int.Vcc returns to a predetermined voltage level.

In the digital VDC 100,111 of the present invention, the output transistor can be turned on at the elapse of Δt1, so that the drop of the voltage can be suppressed to a small level. The period of time for int.Vcc to return to the predetermined voltage level can be shortened.

In the case where the level of voltage ext.Vcc is set at a low level under the requirement of lowering the operating voltage, the transition range of Vcp is narrowed since voltage Vcp at the control node can be reduced only to the level of Vn0 in the conventional digital VDC 800. There is a possibility that the logic level of inverter IV1 cannot be inverted.

In this case, current cannot be supplied to supply node 715 since the gate voltage of output transistor 760 cannot be reduced.

Digital VDC 110, 111 of the present invention has the range of the varying level of the voltage at control node Ncp shifted towards a lower level, i.e. to the region corresponding to the ON of the output transistor to prevent the above problem.

In digital VDC 110, Vcp varies in the range from the level of ground voltage GND to the level of Vp0. Since the voltage difference between Vcp when the output transistor is OFF and the logic threshold voltage of inverter IV1 (ext.Vcc/2) is small, rapid response can be effected with respect to reduction of int.Vcc.

In the case where voltage ext.Vcc is set at a low level, the output transistor can be turned on to allow supply of current to supply node 15 since a signal of an L level can be output from inverter IV2.

Furthermore, a low voltage operation margin of the differential amplify circuit itself can be ensured since the differential amplify circuit receives lower voltages Vc and Vr obtained by converting the levels of int.Vcc and target voltage Vref.

According to digital VDC 111, output transistor 60 can be reliably turned off without depending on the voltage of control node Ncp attaining a floating state in a non-operation mode. Therefore, stable operation can be achieved at circuitry receiving the internal power supply voltage.

Second Embodiment

Another structure of a voltage shift circuit according to a second embodiment of the present invention will be described hereinafter.

Figure 8:
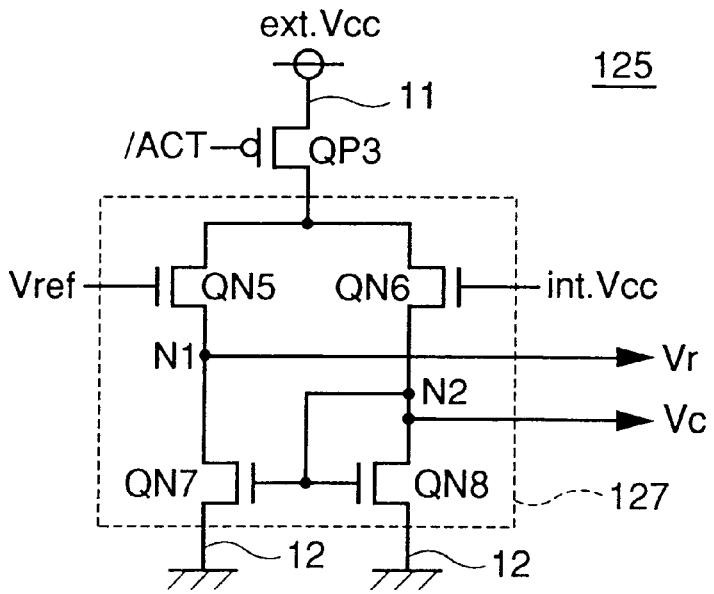
FIG. 8 is a circuit diagram showing a structure of a voltage shift circuit 125 according to a second embodiment of the present invention.

FIG. 8 is a circuit diagram showing a structure of a voltage shift circuit 125 in a digital VDC according to the second embodiment of the present invention. The voltage generation circuit of the second embodiment differs from voltage generation circuit 100 of the first embodiment in that a voltage shift circuit 125 is provided instead of voltage shift circuit 120. The structure of the remaining circuits and operation thereof are identical. Therefore, description thereof will not be repeated.

Referring to FIG. 8, voltage shift circuit 125 includes a current mirror differential amplifier 127, and a P type MOS transistor QP3 connected between external power supply line 11 and current mirror differential amplifier 127.

Activation signal/ACT is applied to the gate of transistor QP3, whereby the amount of current supplied to current mirror differential amplifier 127 is controlled.

Current mirror differential amplifier 127 includes a transistor QN5 connected between a node N1 at which reference voltage signal Vr is generated and transistor QP3, receiving Vref which is the target voltage of int.Vcc at its gate, a transistor QN6 connected between a node N2 from which detection voltage signal Vc is generated and transistor QP3, receiving int.Vcc at its gate, a transistor QN7 connected between node N1 and ground line 12, having its gate connected to node N2, and a transistor QN8 connected between node N2 and ground line 12, having its gate connected to node N2.

By the above structure, reference voltage signal Vr and detection voltage signal Vc are generated to amplify the voltage level difference between int.Vcc and Vref in voltage shift circuit 125.

When int.Vcc=Vref, the setting of Vr=Vc is established in voltage shift circuit 125. When current is consumed at the load to result in int.Vcc<Vref, voltage shift circuit 125 sets Vr and Vc so as to amplify the voltage difference therebetween. Therefore, the voltage level of Vr rises whereas the voltage level of Vc falls, resulting in Vc<Vr.

By the above structure, the voltage levels of int.Vcc and Vref can be shifted, and signals Vc and Vr having the voltage difference therebetween amplified can be obtained by voltage shift circuit 125. By operating differential amplify circuit 30 of FIG. 4 using these signals, deviation of int.Vcc from the target voltage can be reflected rapidly. Therefore, the response of the voltage control of int.Vcc can be improved. Also, generation of excessive current consumption can be prevented in voltage shift circuit 125 since transistor QP3 is connected in series with the current mirror differential amplifier.

Third Embodiment

In the following embodiments 3 and 4, variation in the structure of the digital VDC will be described.

The digital VDC of the third embodiment is directed to further improve the response by applying the voltage level of control node Ncp to the level conversion circuit.

Figure 9:
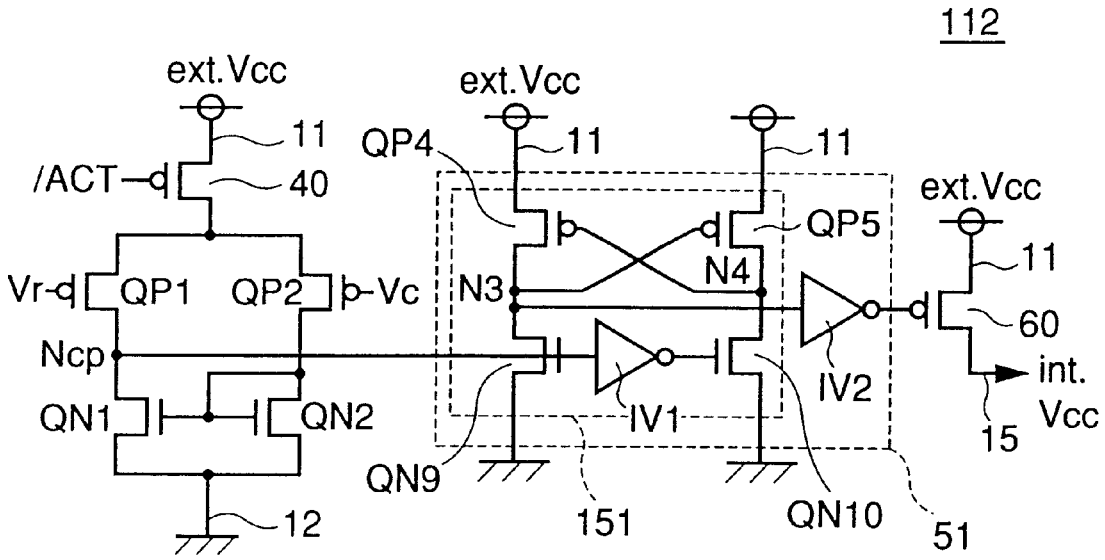
FIG. 9 is a circuit diagram showing a structure of a digital VDC 112 according to a third embodiment of the present invention.

Referring to FIG. 9, a digital VDC 112 of the third embodiment differs from digital VDC 110 of the first embodiment in the structure of the signal conversion circuit. A signal conversion circuit 51 of digital VDC 112 differs from signal conversion circuit 50 of the first embodiment in that a voltage level conversion circuit 151 formed including inverter IV1 is further provided. The structure of the remaining components and operation are similar to those of digital VDC 110. Therefore, description thereof will not be repeated.

Voltage level conversion circuit 151 has a structure including a cross-coupled amplifier. Voltage level conversion circuit 151 includes a P type MOS transistor QP4 connected between external power supply line 11 and a node N3, a P type MOS transistor QP5 connected between external power supply line 11 and a node N4, an N type MOS transistor QN9 connected between node N3 and the ground line, and an N type MOS transistor QN10 connected between node N4 and the ground line.

Control node Ncp is connected to the gate of transistor QN9 and the input node of inverter IV1. Node N3 is connected to the input node of inverter IV2 and the gate of transistor QP5. Node N4 is connected to the gate of transistor QP4.

Voltage level conversion circuit 151 amplifies the change of voltage level Vcp at control node Ncp that varies in the range from ground voltage GND to Vp0, and generates a voltage of either the level of ground voltage GND or external power supply voltage ext.Vcc at node N3.

Therefore, even in the case where the driving current of the differential amplify circuit is restricted and the transition of the voltage generated at control node Ncp is gentle, the small amplitude change can be reflected speedily to apply a digital voltage signal of the ground voltage level or the ext.Vcc level to inverter IV2. Therefore, the gate voltage of output transistor 60 can be controlled by the full amplitude signal of the level from ground voltage GND to ext.Vcc.

By the above structure, particularly after int.Vcc is recovered, supply of excessive current to supply node 15 can be prevented to inhibit generation of int.Vcc overshooting.

In other words, in the case where current is supplied to supply node 15 and the voltage of int.Vcc is recovered to result in int.Vcc≈Vref, the rise of voltage level Vcp, even if slow, at control node Ncp causes rapid change of the voltage level to the input node of inverter IV2 by the voltage level conversion circuit 151. Voltage of an H level (ext.Vcc) is transmitted to the gate of the output transistor to cut off the current supply.

Fourth Embodiment

Figure 10:
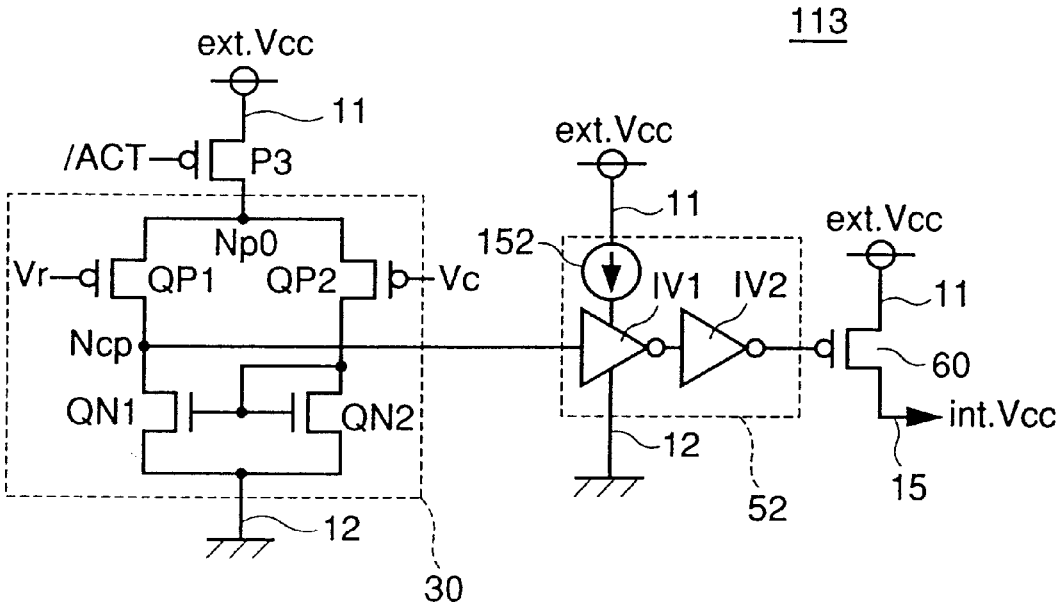
FIG. 10 is a circuit diagram showing a structure of a digital VDC 113 according to a fourth embodiment of the present invention.

FIG. 10 is a circuit diagram showing a structure of a digital VDC 113 according to a fourth embodiment of the present invention. Digital VDC 113 of FIG. 10 differs from digital VDC 110 of the first embodiment in that a signal conversion circuit 52 is provided instead of signal conversion circuit 50. Signal conversion circuit 52 further includes a current control circuit 152 between inverter IV1 and external power supply line 11, as compared to signal conversion circuit 50. The remaining structure and operation are similar to those of digital VDC 100. Therefore, description thereof will not be repeated.

Figure 11:
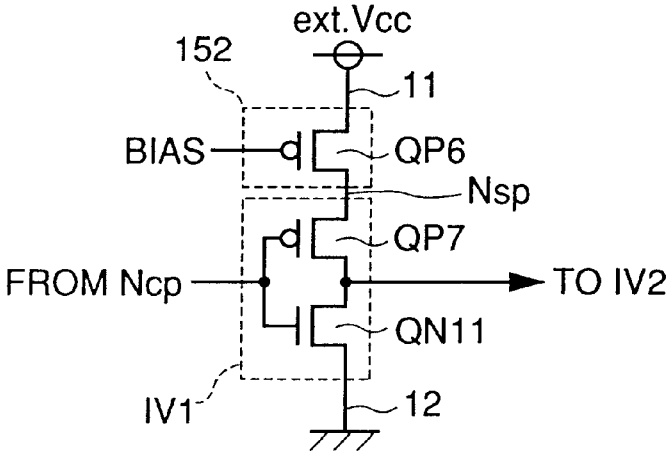
FIG. 11 is a circuit diagram showing a structure of a current control circuit 152.

Referring to FIG. 11, current control circuit 152 includes a P type MOS transistor QP6 connected between external power supply line 11 and node Nsp, receiving a control signal BIAS at its gate.

Transistors QP7 and QN11 constituting inverter IV1 are connected between node Nsp and ground line 12. Control signal BIAS serves to control the amount of the driving current supplied to inverter IV1 by current control circuit 152.

More specifically, by altering the voltage level of control signal BIAS, the gate voltage of transistor QP6 can be altered to allow control of the driving current of inverter IV1.

Voltage level Vcp of control node Ncp takes a value in the range from the level of ground voltage GND to Vp0 which is the voltage level of node Np0, as described before. When internal power supply voltage int.Vcc is maintained at the target voltage, the relationship of the voltage level therebetween becomes Vp0>ext.Vcc/2. Therefore, output transistor 60 is OFF.

In the case where the voltage level of ext.Vcc is set at a low level under the low operating voltage and the voltage difference between Vp0 and ext.Vcc/2 becomes smaller, there is a possibility that, when the voltage of int.Vcc falls so that output transistor 60 is turned on and internal power supply voltage int.Vcc is recovered to the target voltage, the output of inverter IV1 may not be inverted to turn off output transistor 60, depending upon the voltage level change at control node Ncp.

Digital VDC 113 of the fourth embodiment is directed to solve this problem by adding a current control circuit to inverter IV1.

Referring to FIG. 11 again, digital VDC 113 includes transistor QP6 between transistor QP7 and external power supply line 11. Therefore, the source voltage of transistor QP7 constituting inverter IV1 attains the level of Vsp which is lower than that of ext.Vcc. Thus, if voltage level Vcp of the control node applied to the input node of inverter IV1 is at least Vsp/2, the output logic of inverter IV1 can be inverted to allow output transistor 60 to be turned off.

In the case where the voltage difference between Vp0 and ext.Vcc/2 becomes small when the voltage level of ext.Vcc is reduced for a lower operating voltage, the operation margin of inverter IV1 can be ensured by Vsp/2<ext.Vcc/2. By setting an appropriate voltage level for control signal BIAS, the through current of inverter IV1 can be reduced to lower power consumption.

Fifth Embodiment

Figure 12:
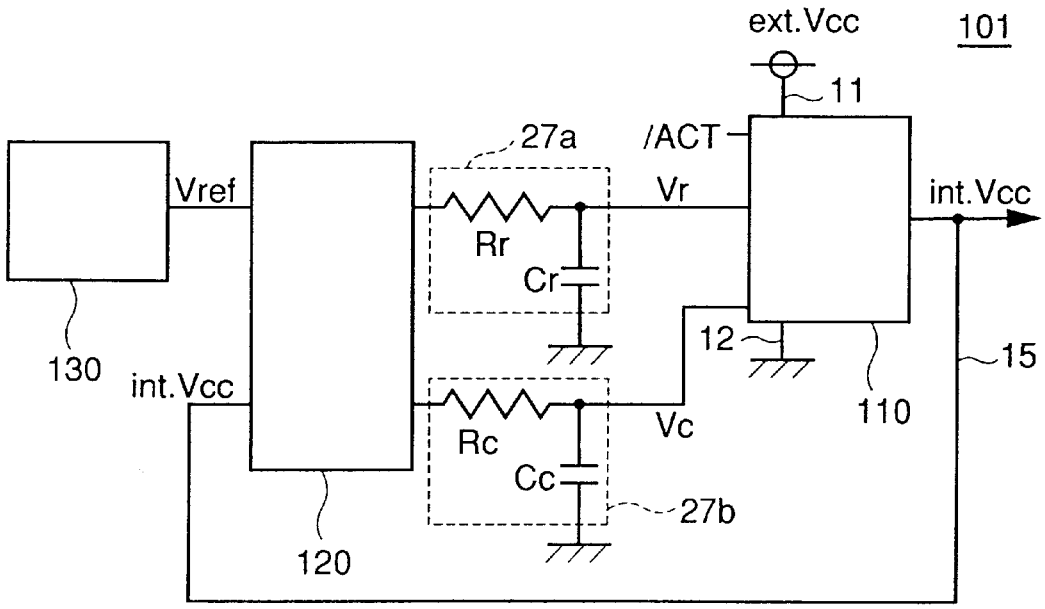
FIG. 12 is a schematic block diagram showing an entire structure of a voltage generation circuit 101 according to a fifth embodiment of the present invention.

FIG. 12 is a block diagram showing an entire structure of a voltage generation circuit 101 according to a fifth embodiment of the present invention.

Referring to FIG. 12, voltage generation circuit 101 differs from voltage generation circuit 100 of the first embodiment in that ripple removal filters 27*a* and 27*b* are provided between voltage shift circuit 120 and digital VDC 110. The remaining structure and operation are similar to those of voltage generation circuit 100. Therefore, description thereof will not be repeated.

In voltage generation circuit 110, reference voltage signal Vr and detection voltage signal Vc generated at voltage shift circuit 120 pass through the ripple removal filter and are then transmitted to digital VDC 110.

Ripple removal filter 27*a* has a low pass filter formed of a resistor Rr and a capacitor Cr. Similarly, ripple removal filter 27*b* has a low pass filter formed of a resistance element Rc and a capacitor Cc. Reference voltage signal Vr is generated as the output of ripple removal filter 27*a*. Similarly, detection voltage signal Vc is generated as the output of ripple removal filter 27*b*.

By the above structure, generation of a voltage level variation of high frequency in voltage signals Vr and Vc is prevented. This prevents the operation of digital VDC 110 of high control sensitivity from becoming unstable. Therefore, the current supply from external power supply line 11 to supply node 15 can be effected more stably. Generation of overshooting and undershooing in internal power supply voltage int.Vcc can be prevented.

Alternatively, voltage shift circuit 125 of the second embodiment can be provided instead of voltage shift circuit 120. In this case, the advantage described in the second embodiment can be also enjoyed. Furthermore, digital VDC 112–113 of the first to fourth embodiments and also any of digital VDC 115–117 that will be described in the following sixth to eighth embodiments can be employed instead of digital VDC 110.

Sixth Embodiment

Figure 13:
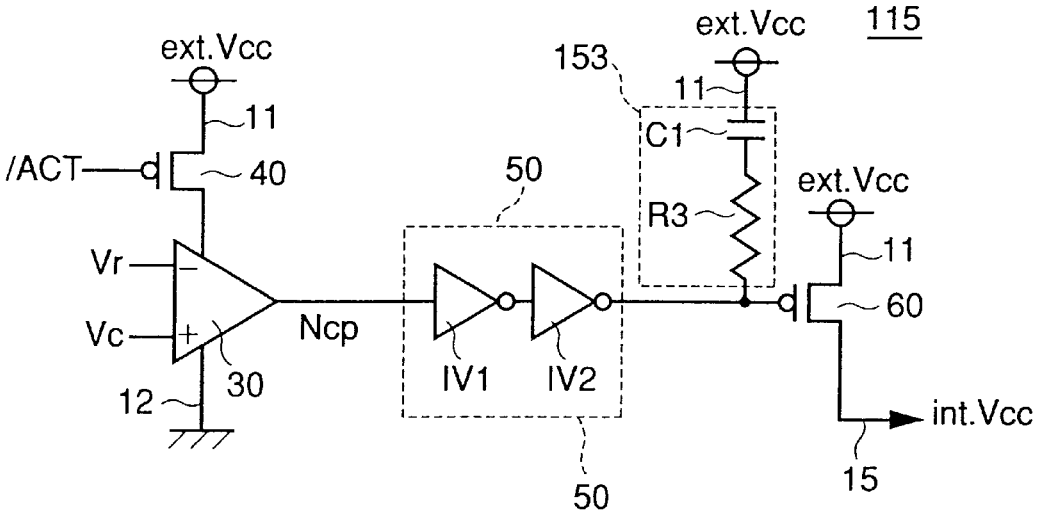
FIG. 13 is a circuit diagram showing a structure of a digital VDC 115 according to a sixth embodiment of the present invention.

FIG. 13 is a circuit diagram showing a structure of a digital VDC 115 in the voltage generation circuit according to a sixth embodiment of the present invention.

Referring to FIG. 13, digital VDC 115 differs from digital VDC 110 of the first embodiment in that a RC circuit 153 connected between the gate of output transistor 60 and external power supply line 110 is further provided.

The remaining structure and operation are similar to those of digital VDC 110, and description thereof will not be repeated.

RC circuit 153 includes a capacitor C1 and a resistance element R3 connected in series. RC circuit 153 serves to render dull the output control signal from inverter IV2 by the RC load and applies that signal to the gate of output transistor 60.

Figure 14:
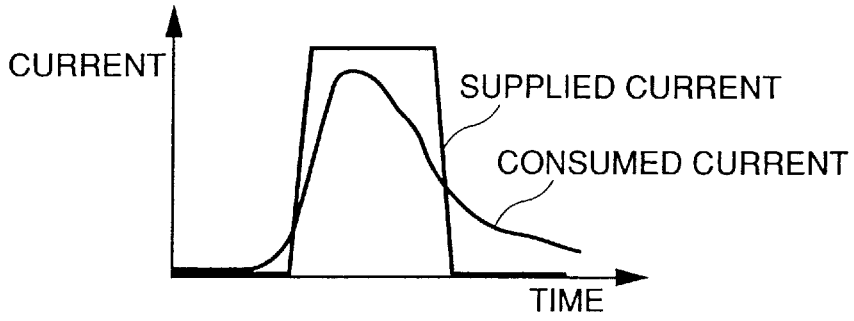
FIG. 14 is a waveform diagram showing the relationship between the consumed current of a general sense amplifier load and the supply current of a digital VDC.

FIG. 14 is a waveform diagram representing the relationship between the consumed current of a general sense amplifier load and the supplied current of the digital VDC.

Referring to FIG. 14, the consumed current of the load sense amplifier circuit has a curved waveform since it is represented equivalently as the RC load. In contrast, the supply current of the digital VDC has a trapezoid waveform since the control response is improved by altering the gate voltage of the output transistor digitally. In this case, there is deviation in the timing between the supplied current of the VDC and the consumed current of the load.

Figure 15:
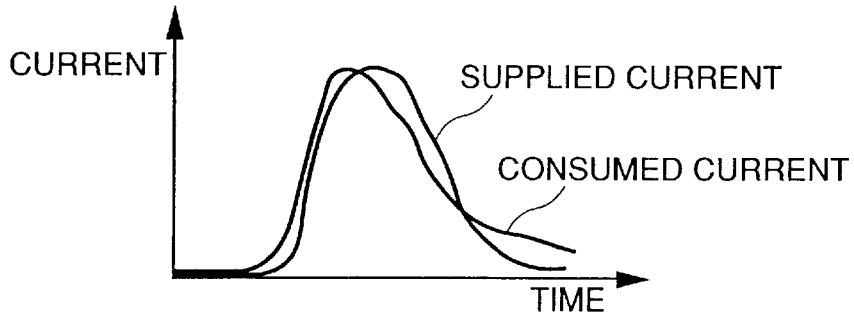
FIG. 15 is a waveform diagram representing the relationship between the current supplied by digital VDC 115 of the sixth embodiment and the consumed current of the sense amplifier load.

FIG. 15 is a waveform diagram representing the relationship between the supplied current by digital VDC 115 and the consumed current of the sense amplifier load.

As described with reference to FIG. 13, the gate voltage of output transistor 60 corresponds to the digital output signal of inverter IV2 rendered dull by RC circuit 153. By virtue of RC circuit 153, the change in the gate voltage of output transistor 60 is smoothed. Accordingly, the current supply from external power supply line 11 to supply node 15 is represented as a curve. Therefore, the waveform of the supplied current by digital VDC 115 has a shape approximating the waveform of the consumed current, so that the timing of the supplied current can be made to approach that of the consumed current. Balance between the amount of consumed current and supplied current can be established. Thus, generation of overshooting and undershooing in internal power supply voltage int.Vcc can be prevented. The voltage of int.Vcc can be controlled more stably.

[Modification of Sixth Embodiment]

Figure 16:
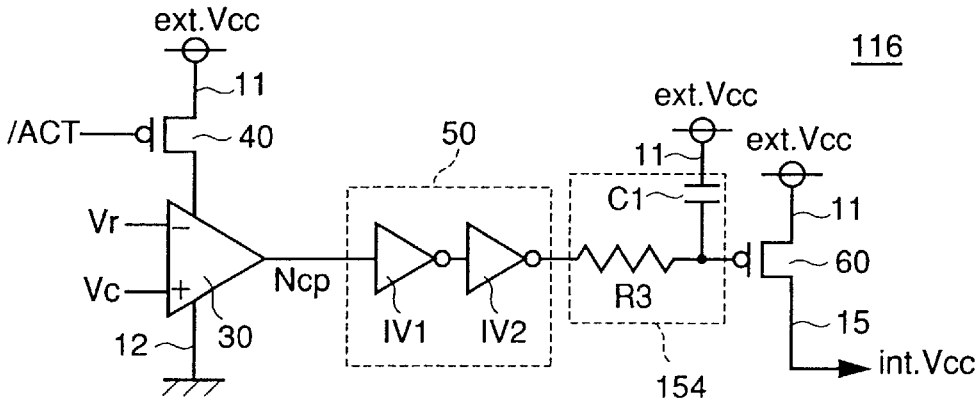
FIG. 16 is a circuit diagram showing a structure of a digital VDC 116 which is a modification of the sixth embodiment.

FIG. 16 is a circuit diagram showing a structure of a digital VDC 116 which is a modification of the sixth embodiment.

Referring to FIG. 16, digital VDC 116 differs from digital VDC 115 of the sixth embodiment shown in FIG. 13 in the structure of the RC circuit. More specifically, a RC circuit 154 of digital VDC 116 has a resistance element R3 connected between the output node of inverter IV2 and the gate of output transistor 60.

By the above structure, the digital output signal of inverter IV2 can be transmitted to the gate of output transistor 60 after being rendered dull. The advantage similar to that of digital VDC 115 of FIG. 13 can be obtained.

Seventh Embodiment

In the seventh embodiment, the layout pattern to form the RC circuit in the digital VDC of the sixth embodiment on a semiconductor substrate will be described.

Figure 17:
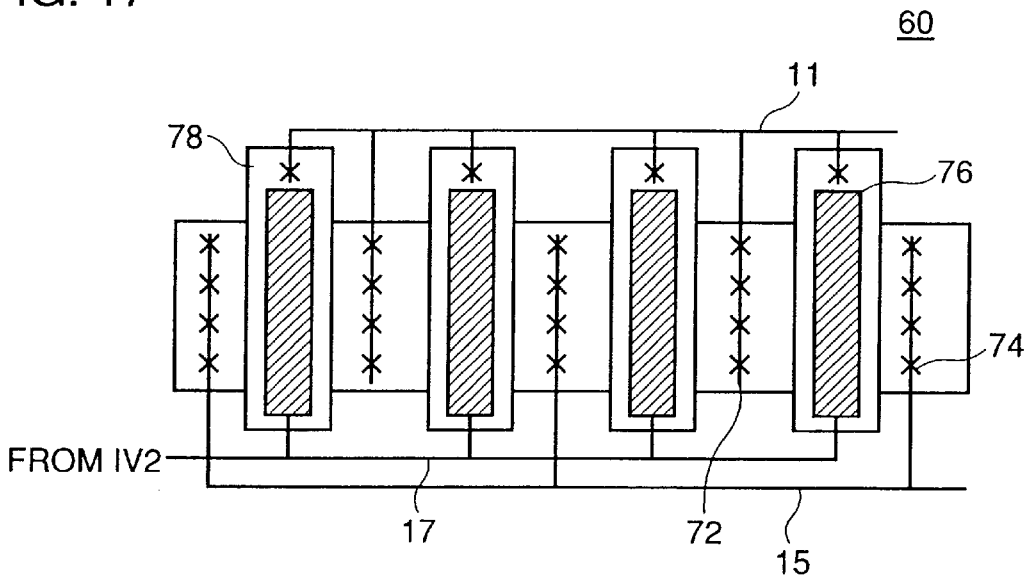
FIG. 17 shows the layout pattern of an output transistor 60 in a seventh embodiment.

FIG. 17 shows the layout pattern of output transistor 60 to realize RC circuit 154 in digital VDC 116 of FIG. 16.

Referring to FIG. 17, output transistor 60 is formed of a plurality of transistors connected in parallel. Each transistor of output transistor 60 includes a contact 72 connected to external power supply line 11, a contact 74 connected to supply node 15, and a gate electrode 76 connected to the output node of inverter IV2. Contact 72 corresponds to the source electrode of output transistor 60. Contact 74 corresponds to the drain electrode of output transistor 60.

A metal interconnection layer 78 connected to external power supply line 11 is provided at the upper layer of gate electrode 76. Metal interconnection layer 78 may employ a bit line layer, for example, in the memory cell array.

Accordingly, a parasitic capacitance is formed between interconnection layer 78 and gate electrode 76 to realize capacitor C1 of FIG. 16. Resistor R3 in the RC circuit can be realized by the interconnection resistance of the line 17 between inverter IV2 and gate electrode 76.

Figure 18:
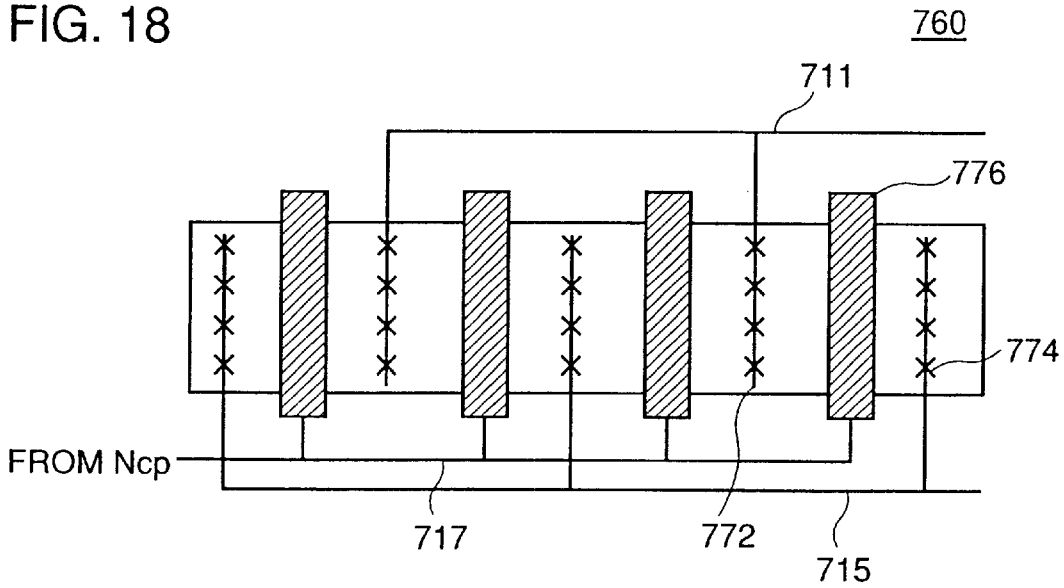
FIG. 18 shows the layout pattern of an output transistor 760 in a conventional digital VDC 800.

FIG. 18 shows a layout pattern of output transistor 760 in a conventional digital VDC 800 for comparison.

Referring to FIG. 18, output transistor 760 is formed of a plurality of transistors connected in parallel, similar to FIG. 17. Each transistor includes a gate electrode 776 connected to the output node of inverter IV2 by a line 717, a contact 772 connected to an external power supply line 711, and a contact 774 connected to supply node 715.

Output transistor 760 requires a high current supply capability since it is provided to supply current to the supply node. Therefore, the gate width of each transistor of output transistor 760 must be designed wide. The layout as shown in FIG. 18 is commonly employed to prevent variation in the transistor performance and to prevent latch up.

By employing the layout pattern of FIG. 17 in the case where a capacitor is applied at the gate input node of output transistor 60, the RC circuit can be provided at a layout area substantially equal to that of a conventional digital VDC.

Eighth Embodiment

Figure 19:
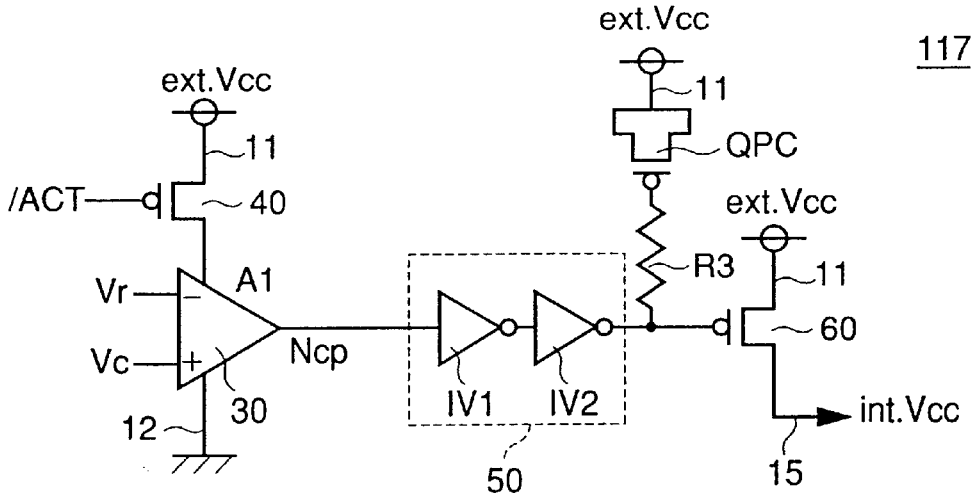
FIG. 19 is a circuit diagram showing a structure of a digital VDC 117 according to an eighth embodiment of the present invention.

FIG. 19 is a circuit diagram showing a structure of a digital VDC 117 according to an eighth embodiment of the present invention.

Referring to FIG. 19, digital VDC 117 has a structure substantially similar to that of digital VDC 115 of the sixth embodiment described with reference to FIG. 13, provided that the capacitor in the RC circuit is realized by the gate capacitance of a P type MOS transistor QPC.

The remaining structure and operation are similar to those of digital VDC 115, and description thereof will not be repeated.

Digital VDC 117 is likewise directed to render dull the output signal of inverter IV2 by a RC circuit formed of the gate capacitance of transistor QPC and resistance element R3.

It is to be noted that the waveform of the gate input signal of output transistor 60 is dulled differently according to the magnitude between the gate capacitance of output transistor 60 and the gate capacitance of transistor QPC. For example, when the gate capacitance (Cg) of output transistor 60 is approximately 5 pF, the rising and falling time of the gate input waveform of output transistor 60 can be designed to be delayed by setting the PMOS capacitance by transistor QPC to approximately 50 pF which is approximately ten times the Cg.

When the voltage level of the output node of inverter IV2 begins to fall from the level of ext.Vcc (at the transition from the H level to the L level) to supply current to supply node 15, no channel is formed at transistor QPC. Therefore, the PMOS capacitance of transistor QPC is small.

This means that the gate voltage of transistor 60 can be driven to an L level (ground voltage GND) relatively speedily. Therefore, current supply can be effected speedily in response to output transistor 60 being turned on.

In the case where the voltage level of the output node of inverter IV2 is driven from an L level to an H level to cease current supply to supply node 15, the PMOS capacitance by transistor QPC is relatively great since a channel is formed at transistor QPC.

In this case, the gate voltage of output transistor 60 changes relatively slowly, so that output transistor 60 can be turned off without supply of excessive current to supply node 15.

In digital VDC 117 of the eighth embodiment, the capacitance of the capacitor functioning as the load at the gate of output transistor 60 can be set to a value differing between the case where the transistor is turned on and turned off. Accordingly, the on/off speed of output transistor 60 can be controlled. Under shooting and overshooting of inat.Vcc at the supply node can be prevented to allow execution of a more stable voltage control.

For the signal conversion circuits in the digital VDC of the sixth to eighth embodiments, signal conversion circuits 51 and 52 described in the third and fourth embodiments can be used.

Ninth Embodiment

In the ninth embodiment, a voltage generation circuit having a combined structure of an analog type VDC that can supply a current according to the consumed current amount and a digital type VDC that can supply a great amount of current speedily with respect to an abrupt consumed current will be described.

Figure 20:
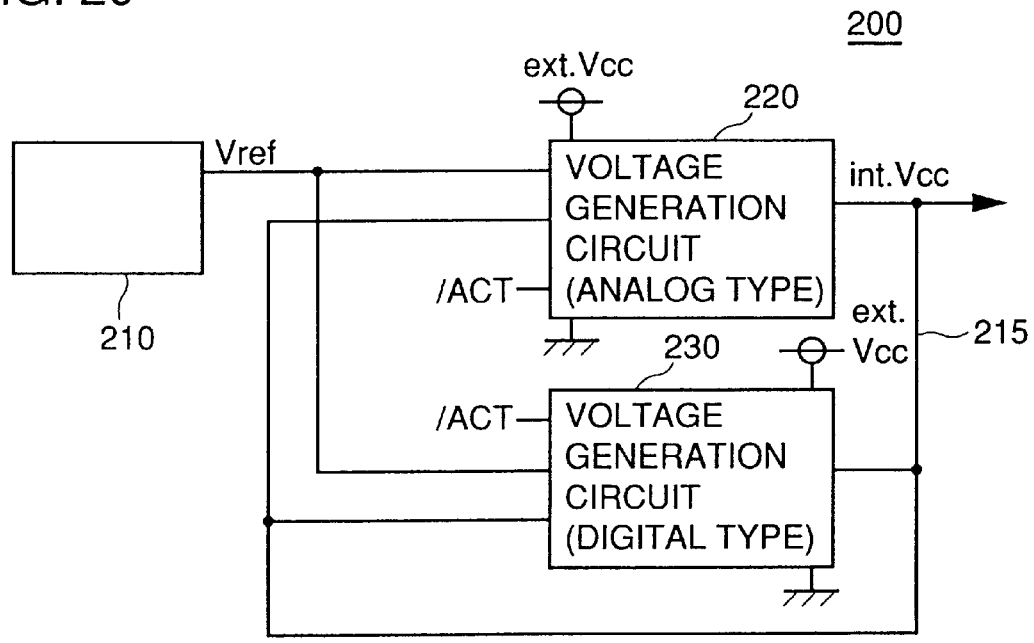
FIG. 20 is a schematic block diagram showing an entire structure of a voltage generation circuit 200 according to a ninth embodiment of the present invention.

FIG. 20 is a schematic block diagram showing an entire structure of a voltage generation circuit 200 according to the ninth embodiment of the present invention.

Referring to FIG. 20, voltage generation circuit 200 includes a Vref generation circuit 210 generating Vref which is the target voltage of internal power supply voltage int.Vcc, an analog type voltage generation circuit 220 provided to control the voltage level of a supply node 215 to the level of target voltage Vref, and a digital type voltage generation circuit 230.

Figure 22:
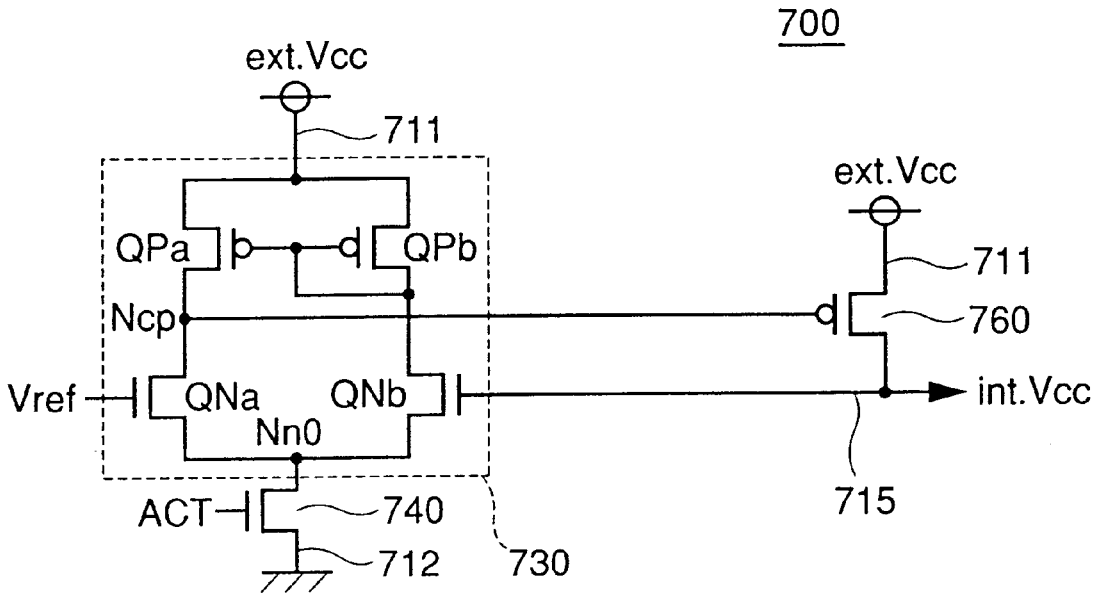
FIG. 22 PRIOR ART
FIG. 22 is a circuit diagram showing a structure of a conventional analog VDC 700.

Analog type voltage generation circuit 220 includes the conventional analog VDC 700 described with reference to FIG. 22. Digital type voltage generation circuit 230 has a structure with any of digital VDC 110–117 described in the previous first to eighth embodiments.

First, attention is focused on the current supply capability by the analog type voltage generation circuit.

Referring to FIG. 22 again, analog VDC 700 has a current control transistor 740 provided between differential amplify circuit 730 and ground line 712. Therefore, when int.Vcc<Vref, the voltage level of control node Ncp falls only to the voltage level Vn0 of node Nn0, not to the level of ground voltage GND.

Voltage Vn0 is higher in level than ground voltage GND by the channel resistance of transistor 740. Therefore, the maximum supply current of analog voltage generation circuit 220 corresponds to the case where the gate voltage of output transistor 760 becomes Vn0. The flowing current here is I (Vn0).

In digital type voltage generation circuit 230 including any of digital VDC 110–117 of the present invention, the gate voltage of output transistor 60 can be reduced to the level of ground voltage GND. Therefore, the maximum supply current can be set to I (GND) greater than I (Vn0).

It is assumed that the relationship between the maximum supply current I (Vn0) of analog type voltage generation circuit 220 and the maximum supply current I (GND) of digital type voltage generation current 230 is represented by the following equation.

$$I(Vn0):I(GND)=1:4$$

Assuming that output transistors of the same size are employed in the analog VDC and the digital VDC, the current supply capability of the digital VDC becomes 4 times that of the analog VDC. In order to realize a current supply capability identical to the case where the transistor gate width is set to Wana=100 $\mu$m in the analog VDC, the gate width Wdig of the output transistor of the digital VDC is to be set to 25 $\mu$m.

In the structure employing only a digital VDC, there was a problem that a slow consumed current that does not cause the output level of the inverter in the signal conversion circuit to be inverted cannot be followed, even though a great amount of current can be supplied with a transistor of the small size. In the structure where only an analog VDC is employed, the current supply cannot accommodate the abrupt consumed current, so that a voltage cannot be controlled stably.

In view of the foregoing, voltage generation circuit 200 of the present embodiment has a structure mixed of an analog VDC and a digital VDC.

Here, the gate width of the output transistor is set to the ratio of Wana: Wdig=4:1. For example, when Wana=50 $\mu$m and Wdig=12.5 $\mu$m, a current supply capability can be realized identical to the case where Wana=100 $\mu$m. Since Wana+Wdig=62.5 $\mu$m in this case, a current supply capability identical to that formed only with an analog VDC (Wana=100 $\mu$m) can be achieved with a transistor of a smaller size.

The gate capacitance of the output transistor can be reduced by an output transistor of a smaller size in the VDC is smaller. Therefore, the on/off response of the output transistor is improved. The control response of the entire voltage generation circuit can be improved. Furthermore, since the voltage generation circuit has a structure in which different types of VDC are incorporated, the current can be supplied to the supply node according to the consumed current to allow stable control of voltage int.Vcc.

More specifically, current is supplied from analog type voltage generation circuit 220 including an analog VDC in the normal case of a gentle current consumption. When high speed supply is required by an abrupt and large amount of current consumption, the current can be supplied from digital type voltage generation circuit 230 including a digital VDC. Accordingly, the response of the voltage generation circuit can be improved, and current supply corresponding to the consumed current can be realized. Thus, internal power supply voltage int.Vcc can be controlled more stably.

In the structures of the second to ninth embodiments, a voltage failing circuit 31 similar to that of FIG. 4B can be provided between control node Ncp and signal conversion circuit 50 or 52.

Tenth Embodiment

In the tenth embodiment of the present invention, a structure of a semiconductor memory device incorporating the voltage generation circuit described in the first to ninth embodiments will be described.

Figure 21:
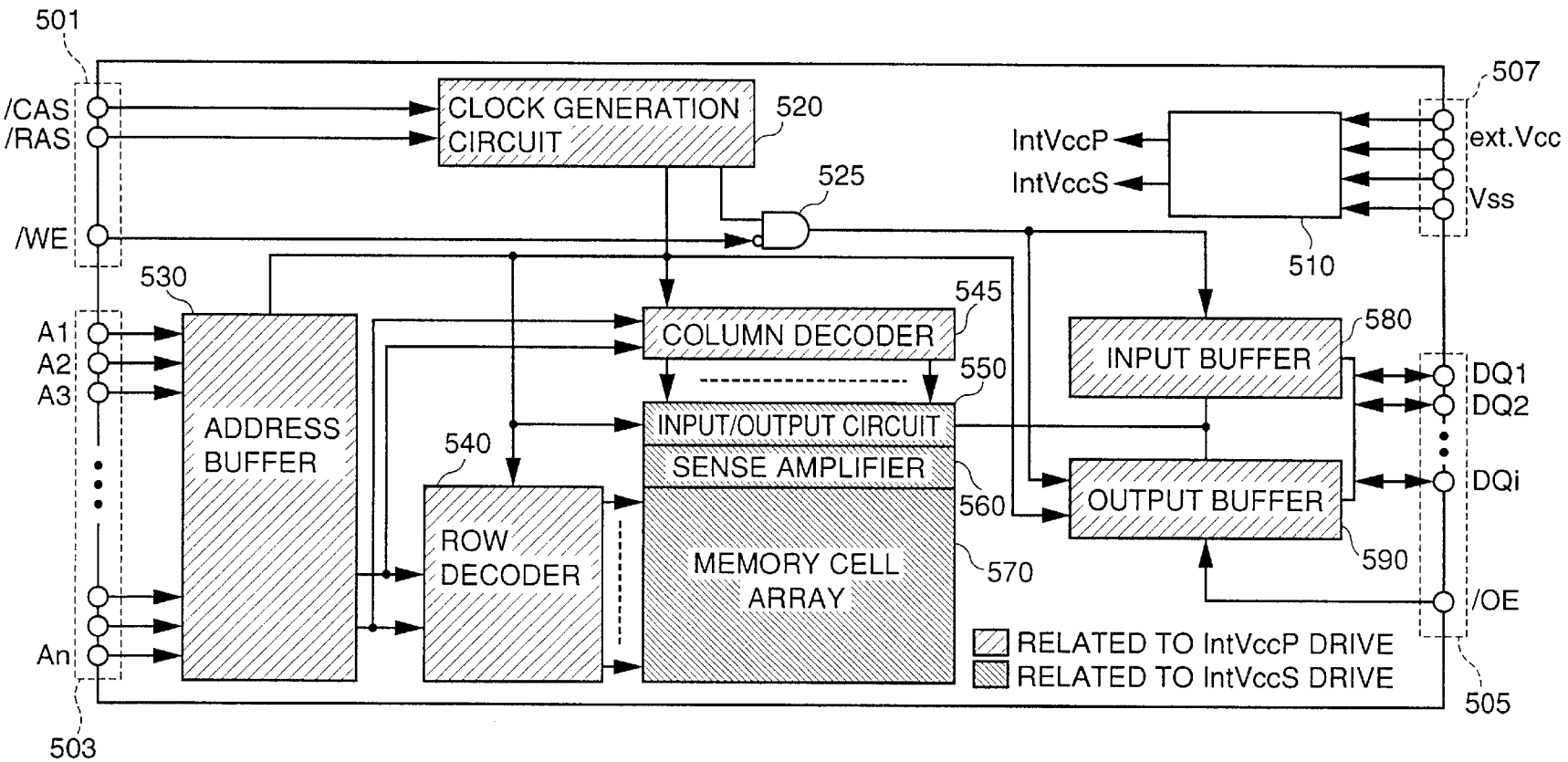
FIG. 21 is a schematic block diagram showing an entire structure of a semiconductor memory device 500 according to a tenth embodiment of the present invention.

FIG. 21 is a schematic block diagram showing an entire structure of a semiconductor memory device 500 according to a tenth embodiment of the present invention.

Referring to FIG. 21, semiconductor memory device 500 includes a control signal input terminal 501 receiving a column address strobe signal /CAS, a row address strobe signal /RAS and a write enable signal /WE, an address input terminal 503 receiving address signals A1–An (n: natural number), a data input/output terminal 505 receiving and providing input/output data DQ1–DQi (i: natural number) and an output enable signal /OE, and a power supply input terminal 507 receiving external power supply voltage ext.Vcc and ground voltage Vss.

Semiconductor memory device 500 further includes a memory cell array 570 with a plurality of memory cells arranged in a matrix, an address buffer 530 to specify a memory cell in response to an address signal in memory cell array, a row decoder 540, and column decoder 545.

In the memory cell array, a word line is arranged for each row of memory cells. A bit line pair is arranged for each column of memory cells. Each memory cell is arranged at the crossing of a word line and a bit line. Row decoder 540 responds to a row address signal supplied from address buffer 530 to select and drive one of the plurality of word lines. Column decoder 545 responds to a column address signal from address buffer 530 to select one of the plurality of bit line pairs.

Sense amplifier 560 includes a plurality of sense amplifiers provided corresponding to each bit line pair. Each sense amplifier amplifies the voltage difference generated between a corresponding pair of bit lines. Input/output circuit 550 supplies to an output buffer 590 the voltage level of the bit line pair selected by column decoder 545. Output buffer 590 amplifies the supplied voltage level and provides the amplified voltage outside as output data DQ1–DQi.

When external write data is provided, input buffer 580 amplifies input data DQ114 DQi. Input/output circuit 550 supplies the input data amplified by input buffer 580 to the bit line pair selected by column decoder 545.

Address buffer 530 selectively supplies the externally applied address signal to row decoder 540 and column decoder 545.

Signal /CAS, /RAS and /WE applied to control signal input terminal 501 are provided to clock generation circuit 520 and logic gate 525 to determine the timing operation of each circuit in the read and write operations of the entire semiconductor memory device 500.

Voltage generation circuit 510 generates internal power supply voltage int.VccP and int.VccS according to ext.Vcc and ground voltage Vss applied to power supply input terminal 507.

Voltage int.VccS is transmitted to memory cell array 570, sense amplifier 560 and input/output circuit 550, and has its level set lower than that of int.VccP to reduce current consumption. In contrast, internal power supply voltage int.VccP is applied to the peripheral circuits such as row decoder 540, column decoder 545, input buffer 580 and output buffer 590.

Voltage generation circuit 510 having a structure of any of those described in the first to ninth embodiments can supply an internal power supply voltage stably even with respect to load having an abrupt consumed current. Therefore, the voltage generation circuit supplying int.VccS which is the internal power supply voltage for the sense amplifier circuit that generates a spike-like consumed current as described with reference to FIG. 14 can be implemented by a digital VDC according to an embodiment of the present invention.

As to int.VccP which is the internal power supply voltage for the peripheral circuits that exhibit a constant relatively gentle current consumption as compared with the spike-like current consumption, the structure of analog VDC 700 described in the section of the background art is to be used. Therefore, voltage generation circuit 510 has a structure including the voltage generation circuit described in the first to ninth embodiments to supply internal power supply voltage int.VccS. Therefore, an internal power supply voltage can be supplied stably even with respect to the load having an abrupt consumed current.

In a digital VDC incorporated in the voltage generation circuit of the present invention, a structure employing a P type MOS transistor for the output transistor was described. However, a similar advantage can be obtained by employing an N type MOS transistor for the output transistor by appropriately adjusting the transistor's polarity in the differential amplify circuit and the side of arrangement of the current supply transistor.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A voltage generation circuit, comprising:

an external power supply line supplying a first voltage;

an internal power supply voltage node from which an internal power supply voltage is output; and a voltage conversion circuit controlling a first current flow supplied from said external power supply line to said internal power supply voltage node to maintain said internal power supply voltage at a target voltage according to a voltage deviation of said internal power supply voltage from said target voltage, said voltage conversion circuit including a switch circuit coupled between said first voltage and an internal node, and turned on according to an activation signal of said voltage generation circuit, an amplify circuit coupled between said internal node and a second voltage, generating a detection deviation signal on a control node, said detection deviation signal having a voltage level according to said voltage deviation within a range from a voltage level of said internal node to said second voltage, a signal conversion circuit driving the voltage level of an output control signal to either one of said first and said second voltages according to the voltage level of said detection deviation signal, and an output current control circuit controlling said first current flow according to the voltage level of said output control signal, wherein said signal conversion circuit setting said output control signal to one of said first and said second voltages, which corresponds to a maximum value of said first current flow, when the voltage level of said detection deviation signal changes from said voltage level of said internal node to said second voltage over a predetermined threshold voltage corresponding to an average of said first and second voltages, and said signal conversion circuit setting said output control signal to the other one of said first and said second voltages, which serves to cut off said first current flow, when the voltage level of said detection deviation signal changes from said second voltage to said voltage level of said internal node over said predetermined threshold voltage.

2. The voltage generation circuit according to claim 1, wherein said signal conversion circuit drives the voltage level of said output control signal according to a comparison result between the voltage level of said detection deviation signal and said predetermined threshold voltage, wherein difference between said predetermined threshold voltage and the voltage level of said internal node is smaller than the difference between said predetermined threshold voltage and said second voltage.

3. The voltage generation circuit according to claim 1, wherein said signal conversion circuit includes a first inverter and a second inverter driven by said first and said second voltages, said first inverter receiving said detection deviation signal as an input, said second inverter inverting an output of said first inverter to provide said output control signal.

4. The voltage generation circuit according to claim 3, wherein said signal conversion circuit further includes a current control transistor electrically coupled between said first inverter and said first voltage, controlling a current flow supplied to said first inverter according to a current control signal received at its gate, wherein said first inverter includes a P type MOS transistor receiving said detection deviation signal at its gate, and electrically coupled between said current control transistor and an input node of said second inverter, and an N type MOS transistor receiving said detection deviation signal at its gate, and electrically coupled between said input node of said second inverter and said second voltage.

5. The voltage generation circuit according to claim 1, wherein said signal conversion circuit comprises a level conversion circuit including a cross-coupled amplifier receiving said detection deviation signal and providing one of said first and said second voltages, and a main inverter inverting the voltage level output from said level conversion circuit to provide said output control signal.

6. The voltage generation circuit according to claim 5, wherein said cross-coupled amplifier includes a first transistor having a gate coupled to an input node of said main inverter, and electrically coupled between said first voltage and a signal node, and a second transistor having a gate coupled to said signal node, and electrically coupled between said first voltage and said input node of said main inverter; and said level conversion circuit further comprises a third transistor receiving said detection deviation signal at its gate, and electrically coupled between said second voltage and said input node of said main inverter, a fourth transistor electrically coupled between said signal node and said second voltage, and a sub inverter receiving said detection deviation signal as an input, and having an output node electrically coupled to a gate of said fourth transistor.

7. The voltage generation circuit according to claim 1, wherein said output current control circuit includes an output transistor receiving said output control signal at its gate, and provided to electrically couple said external power supply line and said internal power supply voltage node, and wherein said voltage conversion circuit further includes an integrating circuit coupled to said signal conversion circuit and said gate of said output transistor for dulling voltage level change of said output control signal, said integrating circuit including a capacitive element electrically coupled between said first voltage and the gate of said output transistor, and a resistance element coupled between said capacitive element and at least one of the gate of said output transistor and said signal conversion circuit.

8. The voltage generation circuit according to claim 7, wherein said capacitive element includes a parasitic capacitance formed between a gate electrode of said output transistor and an interconnection layer formed right above said gate electrode, said interconnection layer being coupled to said first voltage.

9. The voltage generation circuit according to claim 7, wherein said capacitive element includes an MOS transistor having a gate electrically coupled to the gate of said output transistor, and a source and drain coupled to said first voltage.

10. The voltage generation circuit according to claim 1, further comprising a sub voltage conversion circuit controlling a second current flow supplied from said external power supply line to said internal power supply voltage node for maintaining said internal power supply voltage at said target voltage, said sub voltage conversion circuit including a sub switch circuit coupled between said first voltage and a sub internal node, turned on according to said activation signal of said voltage generation circuit, a sub amplify circuit coupled between said sub internal node and said second voltage, generating a sub detection deviation signal having a voltage level according to said voltage deviation within a range from the voltage level of said sub internal node and said second voltage, and a sub output current control circuit controlling said second current flow according to the voltage level of said sub detection deviation signal.

11. The voltage generation circuit according to claim 1, further comprising a voltage fixing circuit disconnecting said control node from an input node of said signal conversion circuit, and coupling said input node with a predetermined voltage so as to set said output control signal to the other one of said first and second voltages which serves to cut off said first current flow, when said switch circuit is turned off in response to inactivation of said activation signal.

12. The voltage generation circuit according to claim 11, wherein said voltage fixing circuit connects said control node with said input node of said signal conversion circuit when said switch circuit is turned on.

13. A voltage generation circuit, comprising:

an external power supply line supplying a first voltage;

an internal power supply voltage node from which an internal power supply voltage is output;

a voltage conversion circuit controlling a first current flow supplied from said external power supply line to said internal power supply voltage node to maintain said internal power supply voltage at a target voltage according to a voltage deviation of said internal power supply voltage from said target voltage, said voltage conversion circuit including a switch circuit coupled between said first voltage and an internal node, and turned on according to an activation signal of said voltage generation circuit, an amplify circuit coupled between said internal node and a second voltage, generating a detection deviation signal on a control node, said detection deviation signal having a voltage level according to said voltage deviation within a range from a voltage level of said internal node to said second voltage, a signal conversion circuit driving the voltage level of an output control signal to one of said first and said second voltages according to the voltage level of said detection deviation signal, and an output current control circuit controlling said first current flow according to the voltage level of said output control signal, said output current control circuit increasing said first current flow as the voltage level of said detection deviation signal changes from said voltage level of said internal node to said second voltage; and a voltage shift circuit generating a reference voltage set lower than said target voltage according to a level of said target voltage and a detection voltage set lower than said internal power supply voltage according to the level of said internal power supply voltage, said amplify circuit setting the voltage level of said detection deviation signal according to a voltage deviation of said detection voltage from said reference voltage.

14. The voltage generation circuit according to claim 13, wherein said voltage shift circuit comprises a first transistor having a gate coupled to said target voltage, and electrically coupled between a first node from which said reference voltage is output and said first voltage, a first resistance element electrically coupled between said first node and said second voltage, a second transistor having a gate coupled with said internal power supply voltage node, and electrically coupled between a second node from which said detection voltage is output and said first voltage, and a second resistance element electrically coupled between said second node and said second voltage.

15. The voltage generation circuit according to claim 13, wherein said first voltage is higher than said second voltage, said output current control circuit includes an output transistor which is a P type MOS transistor electrically coupled between said external power supply line and said internal power supply voltage node, and receiving said output control signal at its gate, said switch circuit includes a current control transistor which is a P type MOS transistor electrically coupled between said first voltage and said amplify circuit, and receiving said activation signal at its gate, and wherein said amplify circuit comprises a first P type MOS transistor electrically coupled between said control node and said current control transistor, and having a gate receiving said reference voltage, a second P type MOS transistor electrically coupled between said current control transistor and a sub node, and having a gate receiving said detection voltage, a first N type MOS transistor electrically coupled between said second voltage and said control node, having a gate coupled to said sub node, and a second N type MOS transistor electrically coupled between said sub node and said second voltage, and having a gate coupled to said sub node.

16. The voltage generation circuit according to claim 13, further comprising:

a first ripple removal circuit electrically coupled between said voltage shift circuit and said voltage conversion circuit for removing an alternating component of said reference voltage, and a second ripple removal circuit electrically coupled between said voltage shift circuit and said voltage conversion circuit for removing an alternating component of said detection voltage.

17. A voltage generation circuit, comprising:

an external power supply line supplying a first voltage;

an internal power supply voltage node from which an internal power supply voltage is output;.

a voltage conversion circuit controlling a first current flow supplied from said external power supply line to said internal power supply voltage node to maintain said internal power supply voltage at a target voltage according to a voltage deviation of said internal power supply voltage from said target voltage, said voltage conversion circuits including a switch circuit coupled between said first voltage and an internal node, and turned on according to an activation signal of said voltage generation circuit, an amplify circuit coupled between said internal node and a second voltage, generating a detection deviation signal on a control node, said detection deviation signal having a voltage level according to said voltage deviation within a range from a voltage level of said internal node to said second voltage, a signal conversion circuit driving the voltage level of an output control signal to one of said first and said second voltages according to the voltage level of said detection deviation signal, and an output current control circuit controlling said first current flow according to the voltage level of said output control signal, said output current control circuit increasing said first current flow as the voltage level of said detection deviation signal changes from said voltage level of said internal node to said second voltage; and a voltage shift circuit generating a reference voltage and a detection voltage according to a voltage difference between said target voltage and said internal power supply voltage, said voltage shift circuit generating said reference voltage and said detection voltage such that the voltage difference between said reference voltage and said detection voltage becomes K times (K is a real number larger than 1) the voltage difference between said target voltage and said internal power supply voltage, said amplify circuit setting the voltage level of said detection deviation signal according to a voltage deviation of said detection voltage from said reference voltage.

18. The voltage generation circuit according to claim 17, wherein said voltage shift circuit comprises a first transistor having a gate coupled to a first node from which said detection voltage is generated, and electrically coupled between said second voltage and said first node, a second transistor having a gate coupled to said first node, and electrically connected between a second node from which said reference voltage is generated and said second voltage, a third transistor having a gate to which said activation control signal is applied, and electrically coupled between said first voltage and a third node, a fourth transistor having a gate coupled to said target voltage, and electrically coupled between said second node and said third node, and a fifth transistor having a gate coupled to said internal power supply voltage node, and electrically coupled between said first node and said third node.

19. The voltage generation circuit according to claim 17, wherein said first voltage is higher than said second voltage, said output current control circuit includes an output transistor which is a P type MOS transistor receiving said output control signal at its gate and electrically coupled between said external power supply line and said internal power supply voltage node, said switch circuit includes a current control transistor which is a P type MOS transistor electrically coupled between said first voltage and said amplify circuit, and having a gate receiving said activation signal, and wherein said amplify circuit comprises a first P type MOS transistor electrically coupled between said control node and said current control transistor, and having a gate receiving said reference voltage, a second P type MOS transistor electrically coupled between said current control transistor and a sub node, and having a gate receiving said detection voltage, a first N type MOS transistor electrically coupled between said second voltage and said control node, and having a gate coupled to said sub node, and a second N type MOS transistor electrically coupled between said sub node and said second voltage, and having a gate coupled to said sub node.

20. The voltage generation circuit according to claim 17, further comprising:

a first ripple removal circuit electrically coupled between said voltage shift circuit and said voltage conversion circuit for removing an alternating component of said reference voltage; and a second ripple removal circuit electrically coupled between said voltage shift circuit and said voltage conversion circuit for removing an alternating component of said detection voltage.

21. A semiconductor memory device that operates receiving a first voltage, comprising:

a memory cell array including a plurality of memory cells arranged in a matrix;

a sense amplifier circuit for amplifying data output from a selected memory cell;

a plurality of peripheral circuits for controlling a data input/output operation with respect to said memory cell array;

each circuit in said semiconductor memory device being divided into a plurality of circuit groups according to a current consumption pattern, a voltage generation circuit receiving said first voltage, and maintaining and supplying an operating voltage at a target voltage for one of said plurality of circuit groups in which said sense amplifier circuit is included, said voltage generation circuit including an external power supply line supplying said first voltage, an operating voltage supply node from which said operating voltage is generated, and a voltage conversion circuit controlling a current flow supplied from said external power supply line to said operating voltage supply node to maintain said operating voltage at said target voltage, said voltage conversion circuit including a switch circuit coupled between said first voltage and an internal node, and turned on according to an activation signal of said voltage generation circuit, an amplify circuit coupled between said internal node and a second voltage, generating a detection deviation signal on a control node, said detection deviation signal having a voltage level according to a voltage deviation of said operation voltage from said target voltage within a range from the voltage level of said internal node to said second voltage, a signal conversion circuit driving the voltage level of an output control signal to either one of said first and said second voltages according to the voltage level of said detection deviation signal, and an output current control circuit controlling said current flow according to the voltage level of said output control signal, wherein said signal conversion circuit setting said output control signal to one of said first and said second voltages, which corresponds to a maximum value of said current flow, when the voltage level of said detection deviation signal changes from said voltage level of said internal node to said second voltage over a predetermined threshold voltage corresponding to an average of said first and second voltages, and said signal conversion circuit setting said output control signal to the other one of said first and said second voltages, which serves to cut off said current flow, when the voltage level of said detection deviation signal changes from said second voltage to said voltage level of said internal node over said predetermined threshold voltage.

* * * * *

UNITED STATES PATENT AND TRADEMARK OFFICE

CERTIFICATE OF CORRECTION

PATENT NO. : 6,392,472 B1
DATED : May 21, 2002
INVENTOR(S) : Mako Koyabayashi et al.

It is certified that error appears in the above-identified patent and that said Letters Patent is hereby corrected as shown below:

Title page,
Item [56], U.S. PATENT DOCUMENTS, change "5,353,935" to -- 5,352,935 --
OTHER PUBLICATIONS, change "Nov. 5, 19094" to -- Nov. 5, 1994 --

Signed and Sealed this

Eighteenth Day of February, 2003

JAMES E. ROGAN
*Director of the United States Patent and Trademark Office*